US008317945B2

(12) United States Patent
Kou

(10) Patent No.: US 8,317,945 B2
(45) Date of Patent: Nov. 27, 2012

(54) HIGH-STRENGTH STEEL PLATE EXCELLENT IN DROP WEIGHT PROPERTIES AND BASE STEEL TOUGHNESS

(75) Inventor: Hiroaki Kou, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 186 days.

(21) Appl. No.: 12/815,840

(22) Filed: Jun. 15, 2010

(65) Prior Publication Data

US 2011/0017356 A1 Jan. 27, 2011

(30) Foreign Application Priority Data

Jul. 27, 2009 (JP) ..... 2009-174303

(51) Int. Cl.
*C22C 38/04* (2006.01)
*C22C 38/12* (2006.01)
*C22C 38/02* (2006.01)

(52) U.S. Cl. ..... 148/330; 148/320; 148/332; 148/334; 148/335

(58) Field of Classification Search ..... 420/121, 420/123, 106; 148/330, 320, 334, 332, 335
See application file for complete search history.

(56) References Cited

FOREIGN PATENT DOCUMENTS

| | | |
|---|---|---|
| CN | 101386955 A | 3/2009 |
| JP | 61-276920 | 12/1986 |
| JP | 2007-169678 | 7/2007 |

OTHER PUBLICATIONS

Machine-English translation ofJapanese patent No. 2004-143504, Hasegawa Toshinaga et al., May 20, 2004.*
Chinese Office Action issued Feb. 3, 2012 in patent application No. 201010239814.2 with English translation.
Office Action, issued May 1, 2012, in Korean Patent Application No. 2010-0071878.

* cited by examiner

*Primary Examiner* — Deborah Yee
(74) *Attorney, Agent, or Firm* — Oblon, Spivak, McClelland, Maier & Neustadt, L.L.P.

(57) ABSTRACT

Disclosed is a steel plate having a specific chemical component composition. The steel plate has an F value defined by the following expression (1) and satisfying the following condition: 3.20≦(F value)≦4.50, has a tempered bainite microstructure having an average equivalent area diameter of grains surrounded by high-angle boundaries with a difference in orientation between two grains of 15° or more of 4 μm or less, and has a tensile strength of 585 MPa or more:

$$F\text{ value}=9.4\times[\text{Mo}]+8.1\times[\text{V}]+4.7\times[\text{Cr}] \quad (1)$$

wherein [Mo], [V] and [Cr] represent contents (percent by mass) of Mo, V, and Cr, respectively. The steel plate having this configuration surely has satisfactory drop weight properties and high base metal toughness only by controlling the contents of necessary alloy elements.

7 Claims, 1 Drawing Sheet

HIGH-STRENGTH STEEL PLATE EXCELLENT IN DROP WEIGHT PROPERTIES AND BASE STEEL TOUGHNESS

FIELD OF THE INVENTION

The present invention relates to steel plates adopted to welded structures such as bridges, high-rise buildings, ships, and tanks. Specifically, the present invention relates to steel plates excellent both in drop weight properties and in base metal toughness.

BACKGROUND OF THE INVENTION

Steel plates prepared through quenching and tempering (hereinafter also referred to as "QT steel plates") have high strength and high toughness, show satisfactory weldability, and have thereby been widely adopted to welded structures such as bridges, high-rise buildings, ships, and tanks. With increasing sizes of such welded structures in recent years, the QT steel plates should have further higher strengths (for example, tensile strengths of 585 MPa or more).

The steel plates should naturally have satisfactory toughness as fundamental properties as base steels (steel plates) and should have excellent drop weight properties as indices of brittle fracture properties. However, known steel plates do not satisfy requirements in these properties when they are designed to have higher strengths and larger gauges.

There is known a good correlation between the drop weight properties and a high-angle boundary grain size. It is also known that reduction of the high-angle boundary grain size is effective for improving the drop weight properties. The "high-angle boundary grain size" refers to the size of a grain surrounded by a high-angle grain boundary with a difference in crystal orientation of 15° or more.

The reduction of the high-angle boundary grain size is most generally performed by finely dividing austenite grains (gamma grains) during quenching. According to this technique, an element that forms carbonitrides even at high temperatures (e.g., Nb and/or Ti) is added to form carbonitrides, and gamma grains are pinned by the action of the carbonitrides to thereby suppress the growth of gamma grains when the steel is heated and held at high temperatures.

This technique, however, fails to finely divide high-angle boundary grains to such an extent as to improve the drop weight properties sufficiently, although the technique gives finely divided gamma grains to thereby give finely divided packets and blocks after transformation, which packets and blocks act as units of fracture.

Another possible technique for reducing the high-angle boundary grain size is increasing hardenability (quenchability), namely, increasing the driving force of transformation to thereby finely divide packets and blocks after transformation.

However, even when the resulting steel plates have better drop weight properties, they may contrarily have inferior base metal toughness, because such steel plates should have larger gauges corresponding to increased demands of large-sized structures, and large amounts of alloy elements should be added to obtain quenched finely divided microstructures in such thick steel plates.

Independently, for example, Japanese Unexamined Patent Application Publication (JP-A) No. S61 (1986)-276920 proposes another technique for improving the drop weight properties. According to this technique, a high-tension steel plate having a predetermined chemical component composition is cooled from a temperature in the range of $Ar_3$ to ($Ar_3$-60° C.) to an arbitrary temperature in the range of 400° C. to 200° C. at a cooling rate of 10° C./second or more to thereby give satisfactory drop weight properties.

This technique, however, is not adoptable to improvements in drop weight properties and base metal toughness of steel plates, because the technique is directed to relatively thin steel plates, and a cooling rate of 10° C./second or more is difficult to achieve in thick steel plates. Under these circumstances, demands have been made to provide steel plates which can surely have satisfactory drop weight properties and base metal toughness only by controlling the contents of necessary alloy elements.

SUMMARY OF THE INVENTION

The present invention has been made under these circumstances, and an object thereof is to provide a steel plate which can surely have satisfactory drop weight properties and base metal toughness only by controlling the contents of necessary alloy elements.

Specifically, the present invention provides, in an embodiment, a steel plate which contains carbon (C) in a content of 0.1 percent by mass to 0.16 percent by mass (hereinafter contents will be simply expressed in "%"), silicon (Si) in a content of 0.05% to 0.5%, manganese (Mn) in a content of 0.9% to 1.6%, aluminum (Al) in a content of 0.01% to 0.06%, molybdenum (Mo) in a content of 0.13% to 0.3%, boron (B) in a content of 0.0005% to 0.002%, and at least one of chromium (Cr) in a content of 0.3% or less and vanadium (V) in a content of 0.07% or less, with the remainder including iron and inevitable impurities, in which the steel plate has an F value defined by the following expression (1) and satisfying the following condition: $3.20 \leqq (F\ \text{value}) \leqq 4.50$, the steel plate has a tempered bainite microstructure in which the average equivalent area diameter of grains surrounded by high-angle boundaries with a difference in orientation between two grains of 15° or more is 4 μm or less, and the steel plate has a tensile strength of 585 MPa or more:

$$F\ \text{value} = 9.4 \times [\text{Mo}] + 8.1 \times [\text{V}] + 4.7 \times [\text{Cr}] \quad (1)$$

wherein [Mo], [V] and [Cr] represent contents (percent by mass) of Mo, V, and Cr, respectively.

As used herein the term "average equivalent area diameter" refers to the average of diameters (equivalent area diameters) of grains surrounded by high-angle grain boundaries with a difference in orientation of 15° or more, which diameters are in terms of circles having the same areas. Assuming that a region surrounded by a high-angle grain boundary with a difference in orientation between two grains of 15° or more is a grain, the average equivalent area diameter of the grain is hereinafter also briefly referred to as a "high-angle boundary grain size".

The steel plate according to the present invention advantageously further contains one or more other elements, such as at least one selected from the group consisting of (a) copper (Cu) in a content of 0.35% or less, (b) nickel (Ni) in a content of 0.6% or less, and (c) calcium (Ca) in a content of 0.003% or less, according to necessity. These elements help the steel plate to have further satisfactory properties according to their types.

According to the present invention, there is provided a steel plate which is a thick steel plate composed of tempered bainite and which surely has satisfactory drop weight properties and high base metal toughness. This steel plate is obtained by adequately controlling the chemical component composition while controlling the F value defined by Expression (1) to fall within the specific range, resulting in reduced sizes of high-angle boundary grains.

DESCRIPTION OF THE PREFERRED EMBODIMENTS

Figure 1:
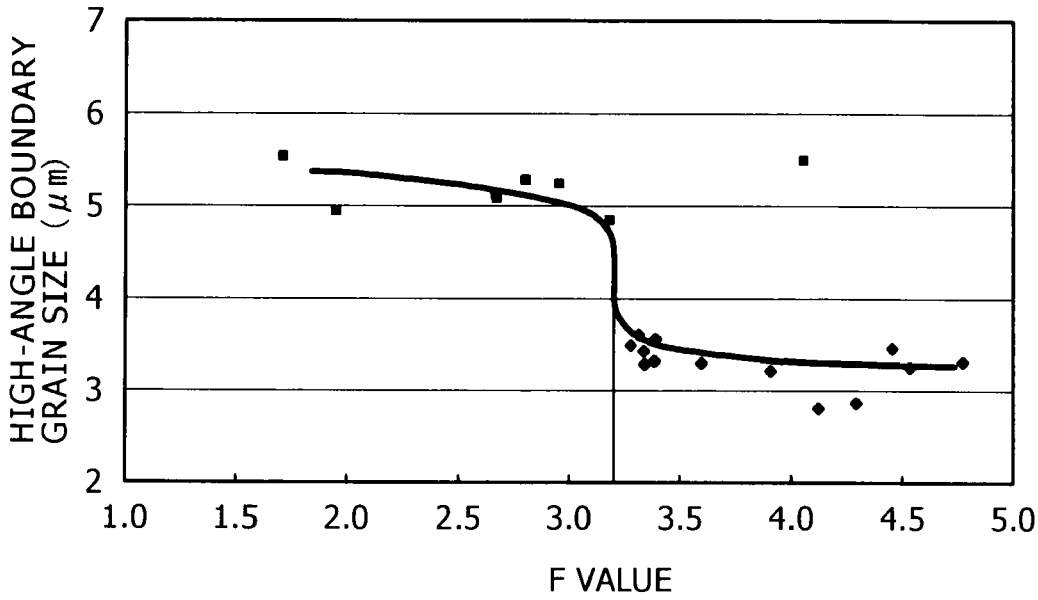
FIG. 1 is a graph showing how the high-angle boundary grain size varies depending on the F value.

The present inventors focused attention on a steel plate composed of tempered bainite in order to ensure strength and base metal toughness at predetermined levels and made intensive investigations from various angles on the way to improve the drop weight properties and toughness of the steel plate. Initially, the present inventors focused attention on boron (B). Boron element is known to be liable to segregate in a solid-solution state at austenite grain boundaries before quenching and, as a result, to suppress nucleation from the grain boundaries and significantly increase hardenability. However, the present inventors have recognized that, when boron is simply added, the content of dissolved boron may be reduced due to precipitation upon quenching and boron may not exhibit satisfactory advantageous effects, because boron is known to precipitate as $Fe_{23}(CB)_6$. Specifically, the present inventors have recognized that it is important to control boron to be present in a solid-solution state for finely dividing the microstructure of steel and for improving the above properties.

The present inventors have therefore made wide and detailed investigations on component compositions to give fine microstructures by increasing the content of dissolved boron to thereby suppress grain formation from grain boundaries and to increase the hardenability. As a result, the present inventors have found a component composition that gives a steel plate having satisfactory drop weight properties and high base metal toughness and having a strength of 585 MPa or more. The present invention has been made based on these findings. Hereinafter the operation and advantageous effects of the present invention will be illustrated along the historical accords of the present invention.

According to the present invention, the chemical component composition of steel is adequately controlled, and the F value defined by following Expression (1) regarding the contents of elements Mo, V, and Cr is controlled to be 3.20 or more and 4.50 or less ($3.20 \leqq$(F value)$\leqq 4.50$):

$$F\text{ value}=9.4\times[\text{Mo}]+8.1\times[\text{V}]+4.7\times[\text{Cr}] \quad (1)$$

wherein [Mo], [V] and [Cr] represent contents (percent by mass) of Mo, V, and Cr, respectively.

Mo, V, and Cr elements are highly capable of forming carbides. These elements, as being contained in predetermined contents, capture carbon in steel to suppress the precipitation of boron. This helps boron to be dissolved in a larger content, and the resulting boron effectively helps the microstructure to be finely divided to the greatest extent possible. The F value defined by following Expression (1) should be 3.20 or more from these viewpoints.

However, the carbide-forming elements, if contained in excess, may contrarily impair the base metal toughness. This is probably because, if the carbide-forming elements are contained in excess, carbides of these elements replace cementite and precipitate at grain boundaries to cause fracture and to reduce the toughness, whereas cementite, which forms in grains during quenching, is believed not to adversely affect the base metal toughness so much. The above phenomenon occurs when the F value exceeds 4.50, and the F value should be 4.50 or less.

Expression (1) is defined by the contents of Mo, V, and Cr which elements help to suppress the precipitation of boron. This expression has been determined by calculating coefficients of effects of respective elements from decrement (i.e., "slope") of the high-angle boundary grain size with respect to the contents of respective elements in a graph in which the high-angle boundary grain size is plotted as the ordinate versus the contents of the respective elements as the abscissa. Of the elements defining the F value, V and Cr are equieffective elements, and advantageous effects of the present invention are obtained when at least one of V and Cr is contained in the steel, as long as the F value defined by Expression (1) falls within the predetermined range. Expression (1) is therefore defined also by an element to be contained according to necessity (V or Cr). When either one of V and Cr is not contained, the F value is calculated according to Expression (1) as the content of the one element being zero, and when the both elements (V and Cr) are contained, the F value is calculated according to Expression (1) as intact.

The steel can have a further fine microstructure and the steel plate can have excellent drop weight properties and high base metal toughness basically by controlling the F value defined by Expression (1) within the appropriate range. In addition, there are adequate ranges of contents of respective elements regarding Expression (1). From these viewpoints, the contents of the respective elements (Mo, V, Cr, and B) are controlled as follows.

[Mo Content: 0.13% to 0.3%]

Molybdenum (Mo) should be contained in a content of 0.13% or more so as to allow the F value to be 3.20 or more (namely, to suppress the precipitation of boron) to the extent possible. However, Mo, if contained in an excessively high content, may impair the weldability and should be contained in a content of 0.3% or less. A preferred lower limit of the Mo content is about 0.2%.

[Cr Content: 0.3% or less, V Content: 0.07% or less]

Chromium (Cr) and/or vanadium (V) elements is contained as elements showing similar effects to those of Mo, because it is difficult for Mo by itself to allow the F value to fall within the specific range due to the upper limit of the Mo content. To exhibit the advantageous effects, at least one of Cr and V is to be contained to allow the F value to fall within the specific range. However, each of these elements, if contained excessively exceeding the specific range, may adversely affect the weldability, and the contents of these elements should be controlled as appropriate, as described above. The Cr content is preferably in the range of about 0.2% to about 0.3%; and the vanadium content is preferably in the range of about 0.015% to about 0.030%.

[B Content: 0.0005% to 0.002%]

Boron (B) should be contained in a content of 0.0005% or more to allow boron to effectively increase the hardenability. However, boron, if contained in an excessively high content, may adversely affect the weldability and should thereby be contained in a content of 0.002% or less. A preferred upper limit of the boron content is about 0.0015%.

Controlling the F value defined by Expression (1) within the appropriate specific range basically allows the steel plate to have a further finely divided microstructure. In such steel plate having a finely divided microstructure, the average equivalent area diameter of grains surrounded by high-angle boundaries with a difference in orientation between two grains of 15° or more is 4 μm or less. The "difference in orientation (difference in crystal orientation)" is also called "twist angle" or "tilt angle". The difference in orientation may be measured according typically to an electron backscattering pattern (EBSP) technique, as in working examples mentioned below.

Next, the fundamental component composition of base steel of the steel plate according to the present invention will be described below. The steel plate according to the present invention does not exhibit excellent mechanical properties, unless the contents of respective chemical components (elements) fall within appropriate ranges, even though the F value defied by Expression (1) regarding the chemical components falls within the predetermined range. Accordingly, the steel plate should not only have the F value defined by appropriate amounts of Mo, Cr, and V [i.e., defined by Expression (1)] within the specific range but also have contents of the respective chemical components within appropriate ranges as mentioned below. Reasons for specifying the ranges of contents of these components are as follows.

[C Content: 0.1% to 0.16%]

Carbon (C) element is important for improving the hardenability of the steel plate to thereby ensure a satisfactory strength. However, the carbon content should be 0.16% or less, because carbon, if contained in excess, may adversely affect the weldability. From the viewpoint of ensuring satisfactory weldability, the carbon content is preferably minimized. However, carbon, if contained in a content of less than 0.1%, may cause insufficient hardenability, and the steel plate may fail to ensure satisfactory strength. A preferred lower limit of the carbon content is 0.11%, and a preferred upper limit thereof is 0.14%.

[Si Content: 0.05% to 0.5%]

Silicon (Si) acts as a deoxidizer during ingot-making of steel to thereby increase the strength of steel effectively. For exhibiting these effects advantageously, the Si content should be 0.05% or more. However, Si, if contained in excess, may adversely affect the weldability, and its content should therefore be 0.5% or less. A preferred lower limit of the Si content is 0.15%, and a preferred upper limit thereof is 0.35%.

[Mn Content: 0.9% to 1.6%]

Manganese (Mn) element helps the steel plate to have a higher strength effectively. For exhibiting these effects advantageously, the Mn content should be 0.9% or more and is preferably 1.4% or more. However, Mn, if contained in an excessively high content exceeding 1.6%, may adversely affect the weldability.

[Al Content: 0.01% to 0.06%]

Aluminum (Al) is added as a deoxidizer. Al, if contained in a content of less than 0.01%, may not exhibit sufficient effects. In contrast, Al, if contained in an excessively high content exceeding 0.06%, may adversely affect the cleanliness of the steel plate. A preferred lower limit of the Al content is 0.04%.

The elements to be contained as specified in the present invention are as described above. The remainder includes iron and inevitable impurities. The steel plate is accepted to contain elements (for example, P, S, N, Sn, As, and Pb) derived typically from raw materials, materials, and production facilities and brought about into the steel as the inevitable impurities. Of these impurities, phosphorus (P), sulfur (S), and nitrogen (N) are preferably controlled as follows. The steel plate according to the present invention advantageously further contains, for example, (a) Cu in a content of 0.35% or less and/or (b) Ni in a content of 0.6% or less according to necessity. These elements, when contained, help the steel plate to have further improved properties according to their types.

[P Content: 0.02% or less]

Phosphorus (P) element is an impurity element which segregates at grain boundaries and thereby causes temper brittleness. Phosphorus is therefore preferably minimized in content. From the viewpoint of ensuring the base metal toughness, the phosphorus content is preferably controlled to be 0.02% or less, and more preferably controlled to be 0.01% or less. However, it is industrially difficult to control the phosphorus content in steel to be zero (0%).

[S Content: 0.01% or less]

Sulfur (S) is an impurity which forms various inclusions with alloy elements in the steel plate and is preferably minimized in content. From the viewpoint of ensuring satisfactory ductility and toughness, the sulfur content is preferably controlled to be 0.01% or less and more preferably controlled to be 0.002% or less. However, it is industrially difficult to control the sulfur content in steel to be zero (0%).

[N Content: 0.01% or less]

Nitrogen (N), if contained in excess, causes an excessively large amount of dissolved nitrogen to thereby impair the toughness of heat affected zone (HAZ). The nitrogen content is thereby preferably controlled to be 0.01% or less, and more preferably controlled to be 0.006% or less. However, it is industrially difficult to control the nitrogen content in steel to be zero (0%).

[Cu Content: 0.35% or less]

Copper (Cu) element is effective for increasing the strength. However, Cu, if contained in excess, may cause cracking during hot working and may adversely affect the weldability. The Cu content is therefore preferably controlled to be 0.35% or less. A preferred range of the Cu content is 0.10% to 0.20% for allowing Cu to exhibit its effects advantageously.

[Ni Content: 0.6% or less]

Nickel (Ni) element effectively acts for increasing both strength and toughness of the steel plate. However, Ni, if contained in excess, may adversely affect the weldability. The Ni content is therefore preferably controlled to be 0.6% or less. Ni is preferably contained in the range of 0.3% to 0.5%.

[Ca Content: 0.003% or less]

Calcium (Ca) element is effective for improving the toughness of the steel plate by controlling inclusions. However, the Ca content is preferably controlled to be 0.003% or less, because Ca, if contained in excess, may cause increased amounts of inclusions in steel and may thereby impairs the toughness and performance of the welded joint.

The steel plate according to the present invention has a tempered bainite microstructure. Such a microstructure mainly containing tempered bainite can be obtained by cooling steel in an austenite state to be supercooled to thereby give a bainite microstructure, and tempering the steel having the bainite microstructure.

The steel plate according to the present invention may be produced by making a QT steel plate under general conditions (e.g., rolling temperature, draft, rolling reduction, quenching temperature, and tempering temperature) from an ingot steel satisfying the component composition. In this process, quenching of the steel plate is preferably performed at a temperature of 880° C. or higher, from the viewpoint of further suppressing the precipitation of boron.

The present invention relates to steel plates. The term "steel plate" generally refers to a steel plate having a gauge of 3.0 mm or more, as specified in Japanese Industrial Standards (JIS). However, the gauge of the steel plate to which the present invention is applied is preferably 80 mm or more, and more preferably 90 mm or more. Specifically, according to the present invention, steel plates even having large gauges show satisfactory drop weight properties and high base metal toughness. The steel plates according to the present invention thus obtained are usable as materials for structures such as bridges, high-rise buildings, ships, and tanks.

EXAMPLES

The present invention will be illustrated in further detail with reference to several working examples below. It should be noted, however, that these examples are never intended to limit the scope of the present invention, and various alternations and modifications may be made without departing from the scope and spirit of the present invention and are all included within the technical scope of the present invention.

A series of steel plates (QT steel plates) was produced by making ingots from steels having the compositions given in Table 1 below, according to a common ingot-making process; cooling the ingots to give slabs (210 mm long and 150 mm wide in cross section); heating the slabs to 1100° C. and performing hot rolling to give hot-rolled steel plates having gauges of 90 mm; heating the hot-rolled steel plates to 930° C.; quenching (Q) the heated steel plates; and tempering (T) the quenched steel plates.

TABLE 1

| Sample | Chemical component composition* (percent by mass) | | | | | | | | | | | | | |
|---|---|---|---|---|---|---|---|---|---|---|---|---|---|---|
| number | C | Si | Mn | P | S | Al | Cu | Ni | Cr | Mo | V | B | Ca | N |
| 1 | 0.12 | 0.26 | 1.30 | 0.005 | 0.0008 | 0.054 | 0.20 | 0.44 | 0.15 | 0.10 | 0.035 | 0.0009 | 0.0014 | 0.0050 |
| 2 | 0.13 | 0.26 | 1.54 | 0.005 | 0.0008 | 0.052 | 0.30 | 0.54 | 0.25 | 0 | 0.065 | 0.0008 | 0.0013 | 0.0052 |
| 3 | 0.10 | 0.25 | 1.54 | 0.005 | 0.0012 | 0.053 | 0.10 | 0.24 | 0.15 | 0.20 | 0.025 | 0.0010 | 0.0013 | 0.0049 |
| 4 | 0.11 | 0.26 | 1.44 | 0.004 | 0.0015 | 0.057 | 0.20 | 0.35 | 0.10 | 0.22 | 0.015 | 0.0008 | 0.0014 | 0.0051 |
| 5 | 0.11 | 0.25 | 1.34 | 0.005 | 0.0011 | 0.056 | 0.25 | 0.50 | 0.15 | 0.18 | 0.066 | 0.0008 | 0.0015 | 0.0050 |
| 6 | 0.12 | 0.25 | 1.30 | 0.005 | 0.0008 | 0.056 | 0.15 | 0.35 | 0.12 | 0.25 | 0.030 | 0.0011 | 0.0014 | 0.0050 |
| 7 | 0.12 | 0.26 | 1.45 | 0.010 | 0.0020 | 0.034 | 0.20 | 0.44 | 0.25 | 0.25 | 0.064 | 0 | 0.0015 | 0.0048 |
| 8 | 0.11 | 0.26 | 1.50 | 0.005 | 0.0010 | 0.055 | 0.10 | 0.30 | 0.28 | 0.28 | 0.070 | 0.0009 | 0.0014 | 0.0058 |
| 9 | 0.11 | 0.20 | 1.55 | 0.005 | 0.0010 | 0.054 | 0.15 | 0.25 | 0.30 | 0.30 | 0.065 | 0.0010 | 0.0014 | 0.0049 |
| 10 | 0.13 | 0.26 | 1.55 | 0.005 | 0.0012 | 0.054 | 0.30 | 0.54 | 0.26 | 0.25 | 0 | 0.0008 | 0.0013 | 0.0050 |
| 11 | 0.13 | 0.25 | 1.56 | 0.005 | 0.0017 | 0.057 | 0 | 0 | 0.20 | 0.25 | 0 | 0.0008 | 0 | 0.0048 |
| 12 | 0.11 | 0.26 | 1.54 | 0.005 | 0.0009 | 0.057 | 0.15 | 0.30 | 0.26 | 0.25 | 0.064 | 0.0011 | 0 | 0.0049 |
| 13 | 0.13 | 0.26 | 1.55 | 0.005 | 0.0018 | 0.056 | 0.16 | 0.39 | 0.25 | 0.27 | 0.020 | 0.0009 | 0.0014 | 0.0050 |
| 14 | 0.13 | 0.26 | 1.55 | 0.004 | 0.0016 | 0.056 | 0.16 | 0.34 | 0.25 | 0.21 | 0.020 | 0.0010 | 0.0014 | 0.0047 |
| 15 | 0.12 | 0.26 | 1.55 | 0.005 | 0.0015 | 0.056 | 0.15 | 0.39 | 0.20 | 0.24 | 0.015 | 0.0010 | 0.0015 | 0.0051 |
| 16 | 0.10 | 0.07 | 1.55 | 0.005 | 0.0010 | 0.055 | 0.20 | 0.45 | 0.30 | 0.30 | 0.025 | 0.0011 | 0.0023 | 0.0049 |
| 17 | 0.13 | 0.45 | 1.16 | 0.005 | 0.0008 | 0.054 | 0.32 | 0.55 | 0.26 | 0.28 | 0.051 | 0.0008 | 0.0014 | 0.0049 |
| 18 | 0.12 | 0.25 | 1.55 | 0.004 | 0.0012 | 0.055 | 0.25 | 0.55 | 0.20 | 0.20 | 0.060 | 0.0010 | 0.0012 | 0.0051 |
| 19 | 0.16 | 0.25 | 1.50 | 0.005 | 0.0010 | 0.056 | 0.25 | 0.45 | 0 | 0.30 | 0.065 | 0.0018 | 0.0014 | 0.0048 |
| 20 | 0.13 | 0.26 | 1.51 | 0.005 | 0.0009 | 0.056 | 0.30 | 0.59 | 0.30 | 0.14 | 0.065 | 0.0006 | 0.0028 | 0.0049 |
| 21 | 0.16 | 0.30 | 1.60 | 0.004 | 0.0010 | 0.055 | 0 | 0 | 0 | 0.30 | 0.066 | 0.0012 | 0 | 0.0050 |

*Remainder: iron, and inevitable impurities other than P, S, and N

The resulting steel plates were subjected to evaluations of strength (tensile strength; TS) of the base steel, drop weight properties (nil-ductility transition temperature (NDT)) and base metal toughness ($vE_{-30}$) according to the following methods. The results together with calculated F values are shown in Table 2 below. In each evaluation, test pieces were sampled in a position at a depth of one-fourth the thickness (gauge; t) as a representative position of the test piece in thickness direction.

Measurement of Average High-Angle Boundary Grain Size

The high-angle boundary grain size of a sample steel plate was measured in a cross section in a position at a depth of one-fourth the thickness (gauge: t) of the steel plate in a direction parallel with the rolling direction of the steel plate. The measurement was performed through electron backscattering pattern technique using a field emission scanning electron microscope (FE-SEM-EBSP). Specifically, the high-angle boundary grain size was measured while defining a grain boundary as a boundary with a tilt angle (difference in crystal orientation) of 15° or more, using the EBSP system (trade name: "OIM") supplied by Tex SEM Laboratories, Inc. (UT, USA) in combination with the field emission scanning electron microscope. The measurement was performed in a measurement area of 200 times 200 ($\mu m^2$) at measurement intervals (steps) of 0.5 μm, in which measurement points with confidence index of less than 0.1 were excluded from analysis objects. The confidence index indicates the reliability of the measurement azimuth. The average of the measured high-angle boundary grain sizes was calculated and was defined as the "high-angle boundary grain size (average equivalent area diameter)" herein. Data of high-angle boundary grain size of 1.0 μm or less were assessed as measurement noises and were excluded from data to be averaged.

Tensile Test

A test piece according to ASTM A370-05 (0.500-inch round specimen) was sampled from each steel plate in a position at a depth one-fourth the thickness (gauge: t) of the steel plate in a direction perpendicular to the rolling direction, and the test piece was subjected to a tensile test according to ASTM A370-05 to measure the tensile strength (TS). A sample having a tensile strength (TS) of 585 MPa or more was evaluated as being acceptable.

Evaluation of Toughness (Impact Properties) of Base Metal

A test piece according to ASTM A370-05 was sampled from each steel plate in a position at a depth one-fourth the thickness (gauge: t) of the steel plate in a direction perpendicular to the rolling direction, and the base metal toughness of the test piece was evaluated. Specifically, the test piece was subjected to a Charpy impact test at −30° C. in accordance with ASTM A370-05, and an absorbed energy ($vE_{-30}$) was measured.

Evaluation of Drop Weight Properties

A P-3 test piece was prepared from each steel plate, and the nil-ductility transition temperature (NDT) of the test piece was measured in accordance with ASTM E208 as a criterion for the drop weight properties. A sample having a nil-ductility transition temperature (NDT) of lower than −50° C. was evaluated as being acceptable.

TABLE 2

| Sample number | Gauge (mm) | High-angle boundary grain size (μm) | NDT (° C.) | Base steel TS (MPa) | Base steel $vE_{-30}$ (J) | F value |
|---|---|---|---|---|---|---|
| 1 | 90 | 4.97 | −25 | 608 | 235 | 1.93 |
| 2 | 90 | 5.56 | −5 | 642 | 128 | 1.70 |
| 3 | 90 | 5.27 | −15 | 623 | 241 | 2.79 |
| 4 | 90 | 5.11 | −30 | 616 | 208 | 2.66 |
| 5 | 90 | 5.24 | −10 | 637 | 193 | 2.93 |
| 6 | 90 | 4.86 | −25 | 635 | 237 | 3.16 |
| 7 | 90 | 5.49 | −10 | 690 | 105 | 4.04 |
| 8 | 90 | 3.26 | −70 | 697 | 97 | 4.52 |
| 9 | 90 | 3.31 | −60 | 695 | 87 | 4.76 |
| 10 | 90 | 3.33 | −90 | 650 | 217 | 3.57 |
| 11 | 90 | 3.61 | −80 | 634 | 276 | 3.29 |
| 12 | 90 | 2.81 | −60 | 692 | 154 | 4.09 |
| 13 | 90 | 3.25 | −65 | 689 | 223 | 3.88 |
| 14 | 90 | 3.46 | −55 | 654 | 212 | 3.31 |
| 15 | 90 | 3.30 | −60 | 661 | 238 | 3.32 |
| 16 | 90 | 3.45 | −80 | 666 | 169 | 4.43 |
| 17 | 90 | 2.87 | −65 | 670 | 171 | 4.27 |
| 18 | 90 | 3.44 | −65 | 678 | 180 | 3.31 |
| 19 | 90 | 3.32 | −55 | 683 | 174 | 3.35 |
| 20 | 90 | 3.52 | −55 | 691 | 166 | 3.25 |
| 21 | 90 | 3.56 | −55 | 656 | 174 | 3.35 |

Tables 1 and 2 demonstrate as follows. The numbers mentioned below represent sample numbers in Tables 1 and 2. Nos. 10 to 21 are samples which satisfy the conditions specified in the present invention, and which are steel plates having adequately controlled chemical component compositions and F values and showing satisfactory drop weight properties and high base metal toughness.

In contrast, Nos. 1 to 9 are samples which do not satisfy at least one of conditions specified in the present invention and which are inferior at least in drop weight properties. Of these, Nos. 1 to 6 have F values less than the lower limit as specified in the present invention, thereby have not-finely-divided grains, and show inferior drop weight properties. No. 7 does not contain boron, thereby has not-finely-divided grains, and shows inferior drop weight properties. Nos. 8 and 9 have F values exceeding the upper limit specified in the present invention and thereby show inferior base metal toughness, although they have finely divided grains to show satisfactory drop weight properties.

Figure 2:
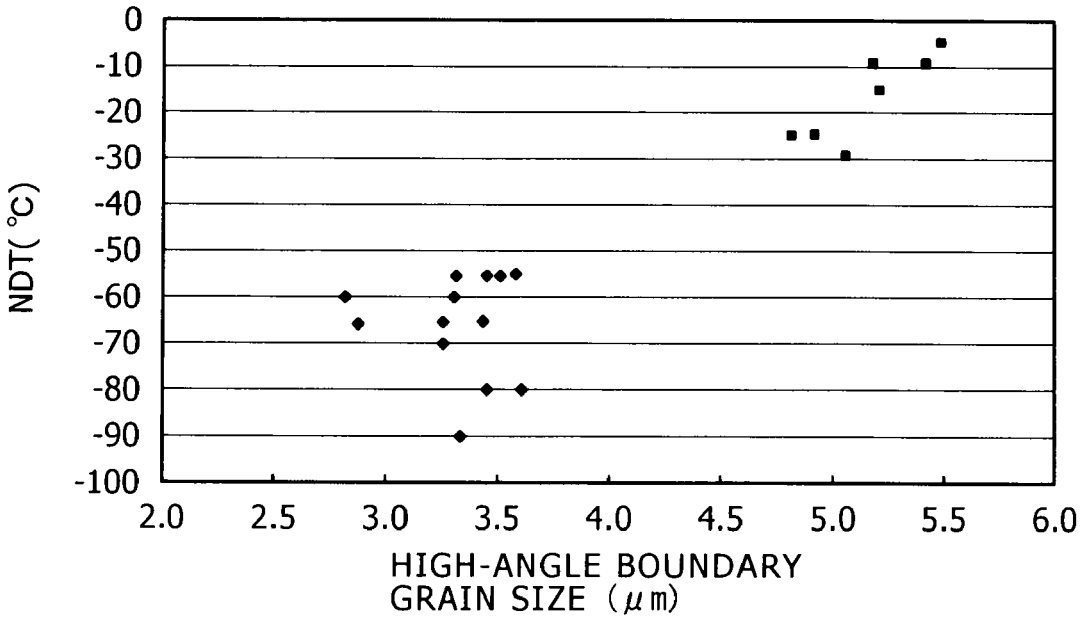
FIG. 2 is a graph showing how the nil-ductility transition temperature (NDT) varies depending on the high-angle boundary grain size.

Based on these results, how the average high-angle boundary grain size varies depending on the F value is shown in FIG. 1; and how the nil-ductility transition temperature (NDT) varies depending on the average high-angle boundary grain size is shown in FIG. 2. These data demonstrate that control of the F value within the range of 3.20 to 4.50 allows the steel plates to have reduced high-angle boundary grain sizes; and that the reduction of the high-angle boundary grain size in turn allows the steel plates to exhibit satisfactory drop weight properties.

What is claimed is:

1. A steel plate, having a composition comprising:

carbon (C) in a content of 0.1 percent by mass to 0.16 percent by mass (hereinafter contents will be simply expressed in "%"), silicon (Si) in a content of 0.05% to 0.35%, manganese (Mn) in a content of 0.9% to 1.6%, aluminum (Al) in a content of 0.01% to 0.06%, molybdenum (Mo) in a content of 0.13% to 0.3%, boron (B) in a content of 0.0005% to 0.002%, and at least one of chromium (Cr) in a content of 0.3% or less and vanadium (V) in a content of 0.07% or less, iron and inevitable impurities, the steel plate having an F value defined by the following expression (1) and satisfying the following condition: 3.20≦(F value)≦4.50, the steel plate having a tempered bainite microstructure in which the average equivalent area diameter of grains surrounded by high-angle boundaries with a difference in orientation between two grains of 15° or more is 4 μm or less, and the steel plate having a tensile strength of 585 MPa or more:

$$F\ value = 9.4\times[Mo]+8.1\times[V]+4.7\times[Cr] \quad (1)$$

wherein [Mo], [V] and [Cr] represent contents (percent by mass) of Mo, V, and Cr, respectively.

2. The steel plate according to claim 1, wherein the composition further comprises copper (Cu) in a content of 0.35% or less.

3. The steel plate according to claim 1, wherein the composition further comprises nickel (Ni) in a content of 0.6% or less.

4. The steel plate according to claim 1, wherein the composition further comprises calcium (Ca) in a content of 0.003% or less.

5. The steel plate according to claim 1, wherein the composition consists essentially of:

carbon (C) in a content of 0.1 percent by mass to 0.16 percent by mass (hereinafter contents will be simply expressed in "%"), silicon (Si) in a content of 0.05% to 0.35%, manganese (Mn) in a content of 0.9% to 1.6%, aluminum (Al) in a content of 0.01% to 0.06%, molybdenum (Mo) in a content of 0.13% to 0.3%, boron (B) in a content of 0.0005% to 0.002%, and at least one of chromium (Cr) in a content of 0.3% or less and vanadium (V) in a content of 0.07% or less, optionally Cu in a content of 0.35% or less, optionally Ni in a content of 0.6% or less, optionally Ca in a content of 0.003% or less, iron and inevitable impurities, the steel plate having an F value defined by the following expression (1) and satisfying the following condition: 3.20≦(F value)≦4.50, the steel plate having a tempered bainite microstructure in which the average equivalent area diameter of grains surrounded by high-angle boundaries with a difference in orientation between two grains of 15° or more is 4 μm or less, and the steel plate having a tensile strength of 585 MPa or more:

$$F\ value = 9.4\times[Mo]+8.1\times[V]+4.7\times[Cr] \quad (1)$$

wherein [Mo], [V] and [Cr] represent contents (percent by mass) of Mo, V, and Cr, respectively.

6. The steel plate according to claim 1, wherein the steel has a nil-ductility transition temperature (NDT) of lower than −50° C.

7. The steel plate according to claim 1, wherein the steel has a tempered bainite microstructure in which the average equivalent area diameter of grains surrounded by high-angle boundaries with a difference in orientation between two grains of 15° or more is in a range of from 2.81 μm to 4 μm.

* * * * *